United States Patent [19]

Manera

[11] 4,062,542

[45] Dec. 13, 1977

[54] TETHER BALL GAME

[76] Inventor: Louis Manera, 11846 N. Schwemer Lane, Mequon, Wis. 53092

[21] Appl. No.: 754,411

[22] Filed: Dec. 27, 1976

[51] Int. Cl.[2] ..... A63F 9/00; A63H 1/32

[52] U.S. Cl. ..... 273/95 A; 46/51

[58] Field of Search ..... 273/95 R, 95 A, 95 AA, 273/96 R, 96 C, 97 R, 98, 99, 106 R, 58 C, 1 R; 46/47, 50, 51

[56] References Cited

U.S. PATENT DOCUMENTS

| | | | |
|---|---|---|---|
| 139,533 | 6/1873 | Batchelder | 46/51 |
| 665,980 | 1/1901 | Roche | 46/51 |
| 1,331,971 | 2/1920 | Adler | 46/51 |
| 1,915,868 | 6/1933 | Rogers | 46/51 |
| 1,932,943 | 10/1933 | Smith | 46/51 |
| 2,158,639 | 5/1939 | Spritzer | 46/51 |
| 2,227,705 | 1/1941 | Colucci | 273/96 R |
| 3,608,235 | 9/1971 | Harton | 46/51 |
| 3,660,929 | 5/1972 | Atkinson | 46/47 |
| 3,693,286 | 9/1976 | Marcotti | 46/47 |

*Primary Examiner*—William H. Grieb

*Attorney, Agent, or Firm*—Andrus, Sceales, Starke & Sawall

[57] ABSTRACT

A circular disc-like core is provided, around which is loosely disposed a ring to which the tether ball cord is fastened. The disc and ring are confined between a pair of annular members so that the tether extends outwardly therebetween. Indicia may be provided between the core and at least one annular member and which are visual therethrough. The indicia may be shifted relative to the tether connection point during ball swinging, thus providing an additional challenge to the operator.

7 Claims, 4 Drawing Figures

TETHER BALL GAME

| Prior Art of Interest | | |
|---|---|---|
| Batchleder | 139,533 | 6-3-73 |
| Roche | 665,980 | 1-15-01 |
| Adler | 1,331,971 | 2-24-20 |
| Rogers | 1,915,868 | 6-20-32 |
| Smith | 1,932,943 | 10-31-33 |
| Spritzer | 2,158,639 | 5-16-39 |
| Harton | 3,608,235 | 9-28-71 |

BACKGROUND AND SUMMARY OF THE INVENTION

This invention relates to a tether ball game which is used to simultaneously whirl in the air, in opposite directions, a plurality of balls or the like. The game is an improvement over those disclosed in the above-identified patents in that it provides a unique handle member for the balls which may be held in several positions to test the skill of the operator. The handle member may also be manipulated internally to provide a further test of skill.

In accordance with the invention, a circular disc-like core is provided, around which is loosely disposed a ring to which the tether ball cord is fastened. The disc and ring are confined between a pair of annular members so that the tether extends outwardly therebetween. By holding the annular members between the thumb and other fingers and using appropriate wrist motions, the balls can be made to swing in opposite directions simultaneously.

In accordance with another aspect of the invention, indicia may be provided between the core and at least one annular member and which are visable therethrough. The indicia may be shifted relative to the tether connection point during ball swinging, thus providing an additional challenge to the operator.

BRIEF DESCRIPTION OF THE DRAWINGS

The accompanying drawings illustrate the best mode presently contemplated by the inventor for carrying out the invention.

In the drawings.

DESCRIPTION OF THE PREFERRED EMBODIMENT

Figure 1:
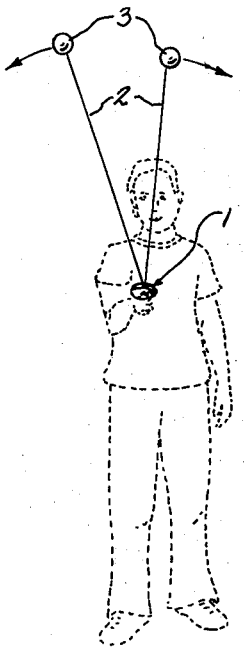
FIG. 1 is a perspective view of a person operating the tether ball game.

As shown in FIG. 1 of the drawings, the game is for the purpose of testing the manipulative skills of a person and generally comprises a handle 1, a tether 2 extending in two segments from the handle, and a pair of balls 3 or the like fastened to the outer ends of the tether segments. The object of the game is to move handle 1 in such a manner that balls 3 swing circumferentially in opposite directions.

Figure 2:
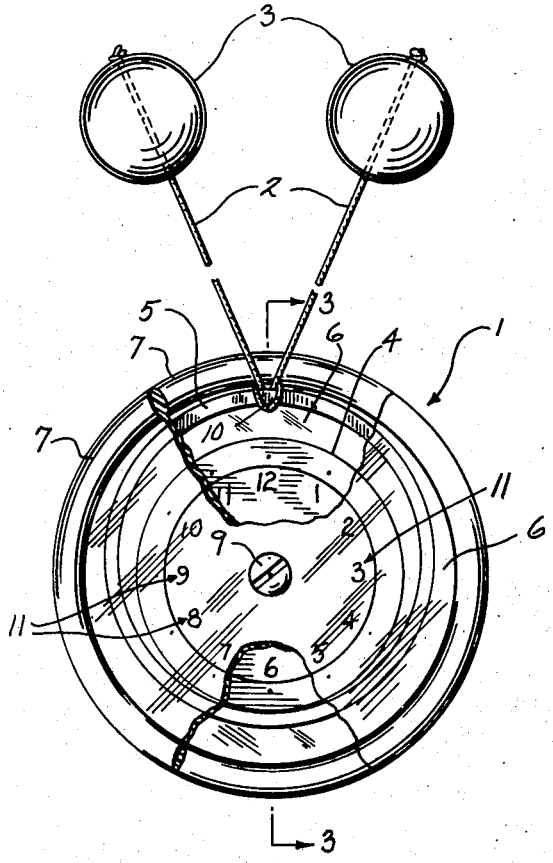
FIG. 2 is a top plan view of the handle for the game, with parts broken away.
Figure 3:
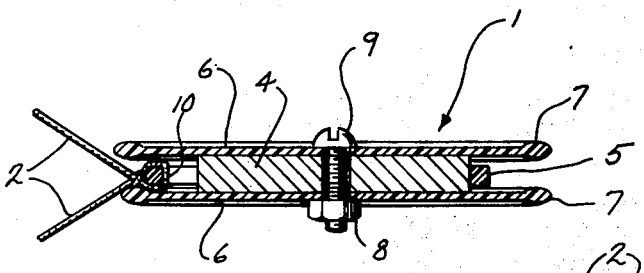
FIG. 3 is a section taken on line 3—3 of FIG. 2.

Referring to FIGS. 2 and 3, handle 1 comprises an annular disc-like generally flat core 4 having a ring 5 of larger diameter extending around the periphery thereof. Ring 5 is of lesser thickness than core 4, and both elements are confined between a pair of thin annular flexible members, such as discs 6 of larger diameter than core 4 and ring 5. Discs 6 have means for assisting in safely grasping handle 1, such as thickened rim portions 7. The entire assembly is loosely held together by means such as a nut 8 extending through the central axis of core 4 and discs 6, and a bolt 9.

Ring 5 provides means rotatable eccentrically about the handle axis and core 4 for mounting tether 2, as by a slip knot 10. The two segments of tether 2 extend outwardly from between discs 6 to balls 3.

During basic operation of the device, handle 1 is grasped between the thumb and other fingers so that the disc edges are slightly deformed, the balls manually started, and then by proper wrist motion the ball swinging is maintained in the usual manner. The handle may be held horizontally, as generally shown in FIG. 1, or vertically as shown in FIG. 2. In addition, the handle may be manipulated between these two positions and even moved in a rolling type action. During swinging of the tether and during various movements of the handle, the forces at knot 10 will have a sideways component in the plane of ring 5. In view of the loose fit, the ring will therefor be caused to rotate eccentrically about core 4 by knot 10.

Figure 4:
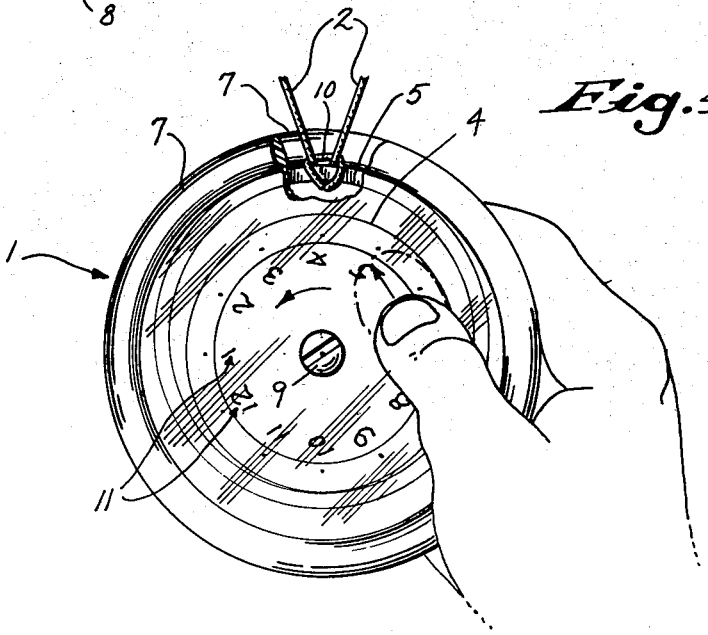
FIG. 4 is a view showing the manner of shifting the indicia, when provided.

In some instances, it may be desirable to add a further challenge to the operator. For this purpose, and as shown in FIGS. 2 and 4, indicia 11 are provided on one of said core 4 or discs 6. In the present embodiment, the indicia are in the form of a clock face having increasing numbers extending clockwise around the handle axis. Indicia 11 are in this instance printed on core 4, and are visible by making the adjacent disc transparent.

In some instances, it may be desirable to place indicia 11 on the inner or outer surface of a disc 6, and this would not depart from the spirit of the invention.

In any event, the indicia 11 and knot 10 form reference points which may be relatively adjusted by a skilled operator during ball swinging. As shown in FIG. 2, knot 10 and the number "12" of indicia 11 are initially in alignment. During the game, and as shown in FIG. 4, the operator may apply suitable pressure with his thumb to a disc 6 and core 4 to manually cause the core (or disc) and indicia to rotate relative to ring 5 and knot 10 until indicia number "4" is aligned with knot 10. Among competing players, the player who can shift the indicia the farthest and possibly bring it back to starting position again, without losing control of the balls, can be said to win the game.

The tether ball game of the invention utilizes an improved structure which provides new challenges to the player as compared to prior known devices.

Various modes of carrying out the invention are contemplated as being within the scope of the following claims particularly pointing out and distinctly claiming the subject matter which is regarded as the invention.

I claim:

1. In a game for simultaneously swinging in opposite directions a pair of balls or the like on the ends of a tether, a handle assembly comprising:

a. an annular generally flat core, b. means rotatable eccentrically about said core for securing the said tether, c. a pair of annular members of larger diameter than said tether securing means and with said members confining said core and tether securing means therebetween, d. and means loosely securing said assembly together on a central axis of said core and annular members.

2. The handle assembly of claim 1 wherein said tether securing means comprises a ring of larger diameter than said core and disposed about the periphery of the latter.

3. The handle assembly of claim 2 wherein said ring is of lesser thickness than said core.

4. The handle assembly of claim 1:

a. which includes visible indicia on one of said core or annular members, b. said indicia being manually rotatable relative to said tether securing means.

5. The handle assembly of claim 4 wherein said indicia is disposed on said core and is visible through the adjacent said annular member.

6. The handle assembly of claim 5 wherein said adjacent annular member is a transparent disc.

7. The handle assembly of claim 4:

a. wherein the securement of said tether to said eccentrically rotatable means is by a knot, b. and said knot and said indicia form relatively adjustable reference points.

* * * * *